US010859936B2

(12) United States Patent
Sugahara et al.

(10) Patent No.: US 10,859,936 B2
(45) Date of Patent: Dec. 8, 2020

(54) MAGNETIC CARRIER, TWO-COMPONENT DEVELOPER, REPLENISHMENT DEVELOPER, AND IMAGE FORMING METHOD

(71) Applicant: CANON KABUSHIKI KAISHA, Tokyo (JP)

(72) Inventors: Nobuyoshi Sugahara, Tokyo (JP); Ryuichiro Matsuo, Moriya (JP); Hironori Minagawa, Moriya (JP); Wakashi Iida, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/571,427

(22) Filed: Sep. 16, 2019

(65) Prior Publication Data

US 2020/0103777 A1 Apr. 2, 2020

(30) Foreign Application Priority Data

Sep. 28, 2018 (JP) ..... 2018-185458

(51) Int. Cl.
*G03G 9/00* (2006.01)
*G03G 9/113* (2006.01)
(Continued)

(52) U.S. Cl.
CPC ..... *G03G 9/1133* (2013.01); *G03G 9/0819* (2013.01); *G03G 9/0827* (2013.01);
(Continued)

(58) Field of Classification Search
CPC ..... G03G 9/1133; G03G 9/1132
(Continued)

(56) References Cited

U.S. PATENT DOCUMENTS 5,437,949 A 8/1995 Kanbayashi et al.
5,607,806 A 3/1997 Kanbayashi et al.
(Continued)

FOREIGN PATENT DOCUMENTS

JP 2002-091092 A 3/2002
JP 2009-237525 A 10/2009
(Continued)

OTHER PUBLICATIONS

U.S. Appl. No. 16/531,306, Ryuichiro Matsuo, filed Aug. 5, 2019.
(Continued)

*Primary Examiner* — Mark A Chapman
(74) *Attorney, Agent, or Firm* — Venable LLP

(57) ABSTRACT

A magnetic carrier comprising a magnetic carrier core and a resin coating layer formed on the surface of the magnetic carrier core, wherein the resin coating layer includes a polymer having a structure represented by the following formula (1), and a content ratio of the structure represented by the formula (1) is from 5% by mass to 95% by mass based on a resin component of the resin coating layer, (1)

(Continued)

wherein, $R^1$ is H or $CH_3$, and X is a structure represented by the following formula (2):

$$—(C_mH_{2m})—R^2—(C_nH_{2n})—OH \quad (2)$$

wherein, $R^2$ is a hydrocarbon group being a cyclic structure having 4 to 8 carbon atoms, and m and n are integers of 0 to 4.

9 Claims, 2 Drawing Sheets

(51) Int. Cl.
*G03G 9/08* (2006.01)
*G03G 9/083* (2006.01)
*G03G 9/107* (2006.01)

(52) U.S. Cl.
CPC ..... *G03G 9/0831* (2013.01); *G03G 9/1075* (2013.01); *G03G 9/1132* (2013.01)

(58) Field of Classification Search
USPC ..... 430/111.35
See application file for complete search history.

(56) References Cited

U.S. PATENT DOCUMENTS 5,635,326 A 6/1997 Kanbayashi et al.
5,670,288 A 9/1997 Okado et al.
5,700,617 A 12/1997 Takiguchi et al.
5,747,209 A 5/1998 Takiguchi et al.
5,851,714 A 12/1998 Taya et al.
5,912,099 A 6/1999 Kanbayashi et al.
5,922,500 A 7/1999 Iida et al.
5,994,018 A 11/1999 Iida et al.
6,013,402 A 1/2000 Kanbayashi et al.
6,022,659 A 2/2000 Kanbayashi et al.
6,077,635 A 6/2000 Okado et al.
6,326,114 B1 12/2001 Itakura et al.
6,528,222 B2 3/2003 Kohtaki et al.
6,586,147 B2 7/2003 Iida et al.
6,664,016 B2 12/2003 Kanbayashi et al.
6,751,424 B2 6/2004 Komatsu et al.
6,808,852 B2 10/2004 Hotta et al.
6,929,894 B2 8/2005 Sugahara et al.
7,115,349 B2 10/2006 Iida et al.
7,138,213 B2 11/2006 Itakura et al.
7,144,668 B2 12/2006 Baba et al.
7,147,980 B2 12/2006 Itakura et al.
7,279,262 B2 10/2007 Fujikawa et al.
7,297,455 B2 11/2007 Fujikawa et al.
7,300,733 B2 11/2007 Sugahara et al.
7,396,626 B2 7/2008 Fujikawa et al.
7,396,629 B2 7/2008 Baba et al.
7,442,478 B2 10/2008 Itakura et al.
7,455,947 B2 11/2008 Ida et al.
7,536,132 B2 5/2009 Minagawa
7,544,457 B2 6/2009 Hashimoto et al.
7,816,063 B2 10/2010 Hashimoto et al.
8,945,805 B2 2/2015 Baba et al.
9,046,800 B2 6/2015 Hotta et al.
9,075,328 B2 7/2015 Minagawa et al.
9,158,217 B2 10/2015 Takahashi et al.
9,372,420 B2 6/2016 Mizo et al.
9,454,094 B2 9/2016 Tsujimoto et al.
9,500,975 B2 11/2016 Sugahara et al.
9,599,920 B2 3/2017 Sugahara et al.
9,606,466 B2 3/2017 Takahashi et al.
9,665,021 B2 5/2017 Ohtsu et al.
9,665,023 B2 5/2017 Kamae et al.
9,671,707 B2 6/2017 Minagawa et al.
9,703,216 B2 7/2017 Tsuchida et al.
9,778,598 B2 10/2017 Onozaki et al.
9,785,070 B2 10/2017 Sugahara et al.
9,915,885 B2 3/2018 Katsumata et al.
9,958,809 B2 5/2018 Sugahara et al.
9,969,834 B2 5/2018 Ohtsu et al.
10,007,206 B2 6/2018 Sugahara et al.
10,012,918 B2 7/2018 Ishigami et al.
10,012,921 B2 7/2018 Kamae et al.
10,133,201 B2 11/2018 Kamae et al.
10,216,108 B2 2/2019 Iwasaki et al.
10,234,777 B2 3/2019 Ohtsu et al.
10,409,188 B2 9/2019 Sugahara et al.
10,423,090 B2 9/2019 Ohtsu et al.
10,451,985 B2 10/2019 Takahashi et al.
2003/0137675 A1 7/2003 Minagawa
2014/0137428 A1 5/2014 Takenaka et al.
2018/0275540 A1 9/2018 Matsuo et al.
2019/0155182 A1 5/2019 Watanabe et al.

FOREIGN PATENT DOCUMENTS

JP 2014-077902 A 5/2014
JP 2015-184485 A 10/2015
JP 2016-048369 A 4/2016
JP 2016-170216 A 9/2016
JP 2017-044792 A 3/2017

OTHER PUBLICATIONS

U.S. Appl. No. 16/539,245, Ryuji Murayama, filed Aug. 13, 2019.
U.S. Appl. No. 16/550,418, Daisuke Tsujimoto, filed Aug. 26, 2019.
U.S. Appl. No. 16/550,452, Takeshi Ohtsu, filed Aug. 26, 2019.
U.S. Appl. No. 16/707,540, Toru Takahashi, filed Dec. 9, 2019.

MAGNETIC CARRIER, TWO-COMPONENT DEVELOPER, REPLENISHMENT DEVELOPER, AND IMAGE FORMING METHOD

BACKGROUND OF THE INVENTION

Field of the Invention

The present invention relates to a magnetic carrier suitable for an image forming method for visualizing an electrostatic image using electrophotography, a two-component developer using the magnetic carrier, a replenishment developer, and an image forming method.

Description of the Related Art

Conventionally, in a typical electrophotographic image forming method, an electrostatic latent image is formed on an electrostatic latent image bearing member by using various means, and a toner is attached to the electrostatic latent image to develop the electrostatic latent image. A two-component development system in which carrier particles called magnetic carrier are mixed with the toner and triboelectrically charged to impart a suitable amount of positive or negative charge to the toner, and the development is performed using this charge as a driving force is widely used in such development.

The advantage of the two-component development system is that since functions such as agitation, transport, and charging of the developer can be imparted to the magnetic carrier, function sharing with the toner is clear, and thus, the controllability of the developer performance is good.

Meanwhile, in recent years, with technological advances in the field of electrophotography, a demand has been growing for increased speed of the apparatus, extended service life and also improved definition, and stable image quality. In order to meet such demand, it is necessary to improve performance of magnetic carriers.

For example, when the speed of the apparatus is raised and the image density is increased, the amount of toner supplied to the developing device is increased, and adhesion of the toner or external additives present on the toner particle surface to the resin coating layer of the carrier is promoted. Therefore, it is required not only to improve the toughness and abrasion resistance of the resin coating layer but also to reduce the adhesion to the toner-derived components.

In order to solve such problems, Japanese Patent Application Publication No. 2014-077902, Japanese Patent Application Publication No. 2016-048369, Japanese Patent Application Publication No. 2017-044792, Japanese Patent Application Publication No. 2016-170216, Japanese Patent Application Publication No. 2015-184485, and Japanese Patent Application Publication No. 2009-237525 propose to reduce density fluctuation even in long-term use particularly under high temperature and high humidity and to stabilize the charge amount even when the toner is allowed to stand for a long time. The carriers described in these documents are characterized by using an alicyclic (meth)acrylic acid monomer for the polymer of a coating resin.

SUMMARY OF THE INVENTION

The magnetic carriers described in the above-mentioned patent literature have solved the problem of adhesion of the resin coating layer to the toner-derived components.

However, in the market, especially in the on-demand printer field, the demand for stability of image quality in long-term use is getting ever stronger. In this regard, the suppression of transfer unevenness, voids and the like caused by deterioration of developer during long-term use is not sufficient.

An object of the present invention is to provide a magnetic carrier which solves the above problems. More specifically, it is an object to provide a magnetic carrier which produces a character image in which transfer unevenness (roughness), voids, and fogging caused by deterioration of developer during long-term use are suppressed, and also to provide a two-component developer, a replenishment developer, and an image forming method that use the magnetic carrier.

The present inventors have found that a magnetic carrier as described below can suppress transfer unevenness, voids and fogging caused by deterioration of developer during long-term use.

That is, the present invention provides a magnetic carrier comprising a magnetic carrier core and a resin coating layer formed on the surface of the magnetic carrier core, wherein the resin coating layer includes a polymer having a structure represented by the following formula (1), and a content of the structure represented by the formula (1) is from 5% by mass to 95% by mass based on a resin component of the resin coating layer.

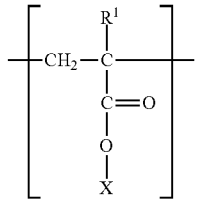

(1)

(In the formula (1), $R^1$ is H or $CH_3$, and X is a structure represented by the following formula (2).)

$$—(C_mH_{2m})—R^2—(C_nH_{2n})—OH \quad (2)$$

(In the formula (2), $R^2$ is a hydrocarbon group being a cyclic structure having 4 to 8 carbon atoms, and m and n are integers of 0 to 4).

The present invention also relates to a two-component developer including a toner comprising a toner particle including a binder resin, and a magnetic carrier, wherein the magnetic carrier is the abovementioned magnetic carrier.

The present invention also relates to a replenishing developer for use in an image forming method which comprises:

a charging step of charging an electrostatic latent image bearing member;

an electrostatic latent image forming step of forming an electrostatic latent image on a surface of the electrostatic latent image bearing member;

a developing step of developing the electrostatic latent image by using a two-component developer in a developing device to form a toner image;

a transfer step of transferring the toner image to a transfer material with or without an intermediate transfer member; and a fixing step of fixing the transferred toner image to the transfer material, and in which the replenishing developer is replenished to the developing device in accordance with a reduction in toner concentration in the two-component developer in the developing device, wherein the replenishing developer includes a magnetic carrier and a toner having a toner particle including a binder resin, the replenishing developer includes from 2 parts by mass to 50 parts by mass of the toner with respect to 1 part by mass of the magnetic carrier, and the magnetic carrier is the abovementioned magnetic carrier.

The present invention also relates to an image forming method comprising:

a charging step of charging an electrostatic latent image bearing member;

an electrostatic latent image forming step of forming an electrostatic latent image on a surface of the electrostatic latent image bearing member;

a developing step of developing the electrostatic latent image by using a two-component developer in a developing device to form a toner image;

a transfer step of transferring the toner image to a transfer material with or without an intermediate transfer member; and a fixing step of fixing the transferred toner image to the transfer material, wherein the two-component developer is the abovementioned two-component developer.

The present invention also relates to an image forming method which comprises:

a charging step of charging an electrostatic latent image bearing member;

an electrostatic latent image forming step of forming an electrostatic latent image on a surface of the electrostatic latent image bearing member;

a developing step of developing the electrostatic latent image by using a two-component developer in a developing device to form a toner image;

a transfer step of transferring the toner image to a transfer material with or without an intermediate transfer member; and a fixing step of fixing the transferred toner image to the transfer material, and in which a replenishing developer is replenished to the developing device in accordance with a reduction in toner concentration in the two-component developer in the developing device, wherein the replenishing developer includes a magnetic carrier and a toner having a toner particle including a binder resin, the replenishing developer includes from 2 parts by mass to 50 parts by mass of the toner with respect to 1 part by mass of the magnetic carrier, and the magnetic carrier is the abovementioned magnetic carrier.

By using the magnetic carrier of the present invention, it is possible to obtain a character image in which transfer unevenness, voids and fogging caused by deterioration of developer during long-term use are suppressed.

Further features of the present invention will become apparent from the following description of exemplary embodiments with reference to the attached drawings.

DESCRIPTION OF THE EMBODIMENTS

Figure 1:
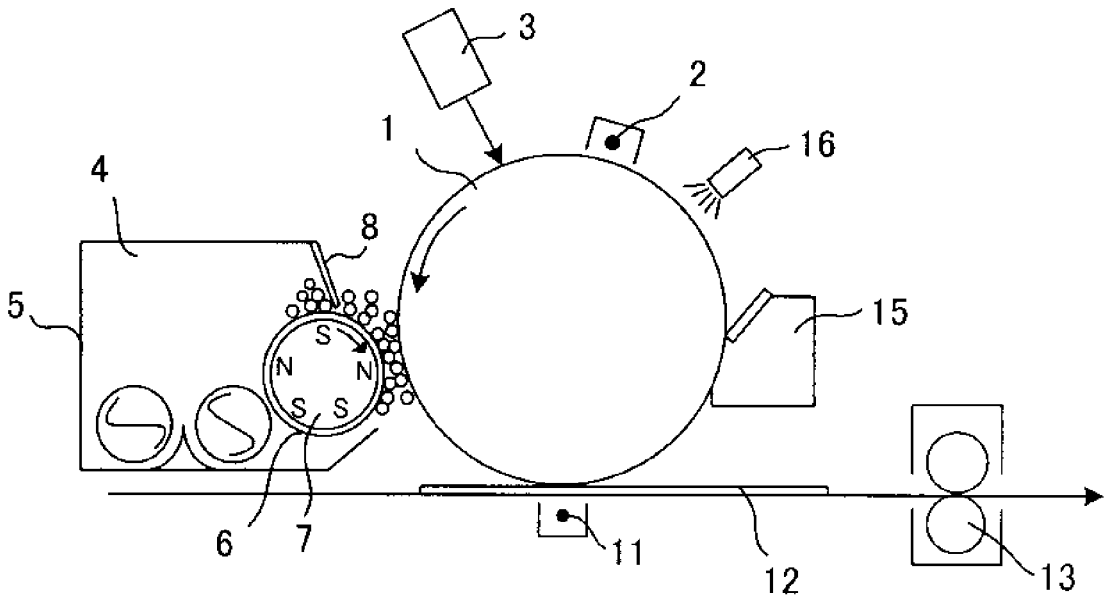
FIG. 1 is a schematic view of an image forming apparatus.

In the present invention, the descriptions of "from XX to YY" or "XX to YY" representing a numerical range mean a numerical range including the lower limit and the upper limit which are endpoints, unless otherwise noted.

Further, a "monomer unit" means the reacted form of a monomer substance in a polymer.

In the present invention, "(meth)acrylic" means "acrylic" and/or "methacrylic".

The magnetic carrier of the present invention has a magnetic carrier core and a resin coating layer formed on the surface of the magnetic carrier core, wherein the resin coating layer includes a polymer having a structure represented by the formula (1), and a content ratio of the structure represented by the formula (1) is from 5% by mass to 95% by mass based on a resin component of the resin coating layer.

Usually, when a toner and a magnetic carrier stay in the developing device for a long period of time, components derived from the toner may adhere to the carrier thereby lowering the charging performance of the carrier.

Meanwhile, the toner which does not fly to the image portion and continues to stay in the developing device continues to receive stress from the carrier. Therefore, an external additive that controls the attachment force and flowability of the toner may be embedded in the toner particle, and the attachment force of the toner may increase. As a result, the "toner release" from the photosensitive member or the intermediate transfer member does not occur properly, and the "voids" in which the tip portions of letters or thin lines are white become prominent. In addition, a rough image with uneven density with respect to a solid image may be outputted.

Accordingly, the inventors of the present invention conducted comprehensive research of the conventional carriers to create a new coating resin capable of further reducing the stress on the toner. As a result, it has been found that the above problem can be solved by including a polymer having a structure represented by the formula (1).

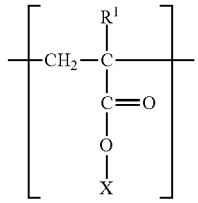

(1)

(In the formula (1), $R^1$ is H or $CH_3$, and X is a structure represented by the following formula (2) (more preferably, the following formula (2')).

$$—(C_mH_{2m})—R^2—(C_nH_{2n})—OH \quad (2)$$

$$—(CH_2)_m—R^2—(CH_2)_n—OH \quad (2')$$

(In the formulas (2) and (2'), $R^2$ is a hydrocarbon group being a cyclic structure having 4 to 8 carbon atoms (preferably a cycloalkylene group having 4 to 8 carbon atoms, more preferably a cycloalkylene group having 5 to 7 carbon atoms, and even more preferably a cyclohexylene group), and m and n are integers of 0 to 4 (preferably 1 to 3, more preferably 1 or 2, and even more preferably 1)).

Heretofore, a coating resin including cyclohexyl (meth) acrylate as a (meth)acrylic monomer having an alicyclic hydrocarbon group has been widely known. By coating the magnetic carrier core with such a coating resin, the smoothness of the magnetic carrier surface layer can be enhanced, the service life of the developer can be extended, and the developer can be better stabilized.

In the present invention, it has been found that by providing a hydroxyl group to a part of the alicyclic hydrocarbon group, the smoothness of the surface layer is further improved, the stress applied to the toner is further reduced, and the "voids" generated due to the deterioration of the toner can be suppressed.

The following reason therefor can be considered. It is conceivable that in the magnetic carrier according to the present invention, since a functional group which may be a steric hindrance is present in part of the alicyclic hydrocarbon group, the smoothness of the carrier surface layer is improved, and further the strength of the resin coating layer is improved by the hydrogen bond created by the hydroxyl group. As a result, it is conceivable that the stress due to the friction between the carrier and the carrier or between the toner and the carrier is reduced, and deterioration of the toner is suppressed.

A structure derived from 1,4-cyclohexanedimethanol monoacrylate is particularly preferable as the structure represented by the formula (1).

The amount of the structure represented by the formula (1) needs to be from 5% by mass to 95% by mass, preferably from 10% by mass to 90% by mass, and even more preferably from 30% by mass to 70% by mass.

When the amount of the structure represented by the formula (1) is in the above range, the reaction when obtaining the coating resin is stable, and the effects of the present invention are easily obtained.

In addition to the structure shown in the formula (1), other monomers may be used for the coating resin to such an extent that the effects of the present invention are not impaired.

As another monomer, it is preferable that the coating resin includes the structure shown by a formula (3) as a copolymer. That is, it is preferable that the polymer which has a structure shown by the formula (1) further has a structure shown by the following formula (3).

(3)

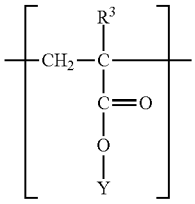

(In the formula (3), $R^3$ represents H or $CH_3$, and Y is H or a hydrocarbon group having 1 to 20 carbon atoms).

As a result of having the structure represented by the formula (3), the charge-providing performance of the magnetic carrier is stabilized, and fogging can be suppressed. Y is preferably an alkyl group having 1 to 20 carbon atoms, more preferably an alkyl group having 1 to 10 carbon atoms, and still more preferably an alkyl group having 1 to 4 carbon atoms.

Examples of the monomer having a structure represented by the formula (3) include methyl acrylate, methyl methacrylate, ethyl acrylate, ethyl methacrylate, propyl acrylate, propyl methacrylate, butyl acrylate (n-butyl, sec-butyl, isobutyl or tert-butyl; same hereinbelow), butyl methacrylate, 2-ethylhexyl acrylate, 2-ethylhexyl methacrylate, acrylic acid or methacrylic acid and the like.

The amount of the structure represented by the formula (3) is preferably from 5% by mass to 90% by mass, more preferably from 8% by mass to 80% by mass, and even more preferably from 8% by mass to 60% by mass, based on the resin component of the resin coating layer. The above ranges are preferable from the viewpoint of the stability of charge.

Moreover, as another monomer, it is preferable that the polymer which has the structure shown by the formula (1) further has a structure derived from styrene. As a result of having a structure derived from styrene in the coating resin, it is possible to suppress the voids and roughness (transfer unevenness) of a solid image caused by transfer. The structure derived from styrene is specifically a structure represented by the following formula (St).

(St)

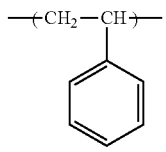

The amount of the structure derived from styrene is preferably from 5% by mass to 90% by mass, more preferably from 10% by mass to 80% by mass, and even more preferably from 10% by mass to 60% by mass, and particularly preferably from 10% by mass to 40% by mass, based on the resin component of the resin coating layer. In the above ranges, the effects of the present invention are easier demonstrated.

Moreover, it is preferable that the polymer having the structure shown by the formula (1) includes a structure derived from a (meth)acrylic acid ester monomer which further has a hydroxyl group. The structure derived from a (meth)acrylic acid ester monomer having a hydroxyl group is represented by the following formula (H).

As a result of including the structure derived from a (meth)acrylic acid ester monomer having a hydroxyl group, the hydroxyl group can be provided, the smoothness of the surface layer is further improved, the stress on the toner is reduced, and the "voids" that are generated by the deterioration of the toner are easy to control.

The amount of the structure derived from a (meth)acrylic acid ester monomer having a hydroxyl group is preferably from 5% by mass to 40% by mass, and more preferably from 5% by mass to 30% by mass, based on the resin component of the resin coating layer.

(H)

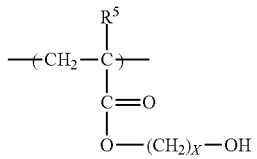

(In the formula, $R^5$ represents H or $CH_3$, and X represents an integer of 1 to 8 (preferably 1 to 6, more preferably 1 to 4)).

Furthermore, it is preferable that the polymer having the structure represented by the formula (1) further has a structure represented by a formula (4). A specific example of the compound represented by the formula (4) is a macromonomer. By using such a macromonomer, it is possible to more effectively suppress voids, transfer unevenness and fogging.

(4)

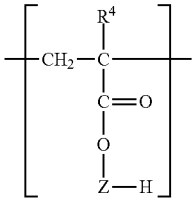

In the formula (4), $R^4$ represents H or $CH_3$. Z represents a bivalent functional group having a polymer as a main chain, and the polymer is a polymer of at least one monomer selected from the group consisting of methyl acrylate, methyl methacrylate, ethyl acrylate, ethyl methacrylate, propyl acrylate, propyl methacrylate, butyl acrylate, butyl methacrylate, 2-ethylhexyl acrylate, 2-ethylhexyl methacrylate, styrene, and acrylonitrile.

Preferably, the polymer is a polymer of at least one monomer selected from the group consisting of methyl acrylate, methyl methacrylate, ethyl acrylate, ethyl methacrylate, propyl acrylate, propyl methacrylate, butyl acrylate and butyl methacrylate. More preferably, the polymer is a polymer of methyl methacrylate.

The weight average molecular weight Mw of the macromonomer portion is preferably from 1000 to 9500. When the weight-average molecular weight is in the above range, the adhesion between the magnetic carrier core and the coating resin is improved, and the effect of suppressing voids, transfer unevenness and fogging tend to be sustained.

From the viewpoint of better exerting the effects of the present invention, the amount of the macromonomer portion (the structure represented by a formula (4)) is preferably from 5% by mass to 90% by mass, and more preferably from 10% by mass to 80% by mass, and even more preferably 10% by mass to 30% by mass, based on the resin component of the resin coating layer.

The amount of the resin coating layer is preferably from 1.0 part by mass to 3.0 parts by mass with respect to 100 parts by mass of the magnetic carrier core. When the amount is 1.0 part by mass or more, the toughness and abrasion resistance of the resin are enhanced, and the change of image density is suppressed. When the amount is 3.0 parts by mass or less, the relaxation property of the charge is further enhanced, and the unevenness in density in the image plane and the reduction in thin line reproducibility are further suppressed.

In addition to the polymer having a structure represented by the formula (1), a resin known as a coating resin may be used for the resin coating layer to the extent that the effects of the present invention are not impaired. The amount of the polymer having a structure represented by the formula (1) is preferably 50% by mass to 100% by mass, more preferably 80% by mass to 100% by mass, and even more preferably 90% by mass to 100% by mass, based on the resin component of the resin coating layer.

The weight average molecular weight Mw of the polymer having a structure represented by the formula (1) is preferably 10,000 to 100,000, and more preferably 20,000 to 80,000.

Next, the magnetic carrier core used in the present invention will be described.

A well-known magnetic carrier core can be used as the magnetic carrier core used for the magnetic carrier of this invention. It is more preferable to use a magnetic body-dispersed resin particle in which a magnetic body is dispersed in a resin component, or a porous magnetic core particle including a resin in a void portion.

These can reduce the true density of the magnetic carrier, and hence can reduce the load on the toner. As a result, even in long-term use, the deterioration of image quality is small and it is possible to reduce the replacement frequency of the developer composed of the toner and the carrier. However, these magnetic carrier cores are not limiting, and the effects of the present invention can be sufficiently exhibited even if a commercially available magnetic carrier core is used.

Examples of the magnetic body component to be used for the magnetic body-dispersed resin particle include various magnetic iron compound particle powders such as magnetite particle powder, maghemite particle powder, and magnetic iron oxide particle powder obtained by including at least one selected from silicon oxide, silicon hydroxide, aluminum oxide, and aluminum hydroxide therein; magnetoplumbite type ferrite particle powder including barium, strontium or barium-strontium; spinel type ferrite particle powder including at least one selected from manganese, nickel, zinc, lithium and magnesium; and the like.

Among these, magnetic iron oxide particle powders are preferably used.

In addition to the magnetic body component, nonmagnetic iron oxide particle powder such as hematite particle powder, nonmagnetic hydrous ferric oxide particle powder such as goethite particle powder, and nonmagnetic inorganic compound particle powder such as titanium oxide particle powder, silica particle powder, talc particle powder, alumina particle powder, barium sulfate particle powder, barium carbonate particle powder, cadmium yellow particle powder, calcium carbonate particle powder, zinc oxide particle powder, and the like may be used in combination with the magnetic iron compound particle powder.

When the magnetic iron compound particle powder and the nonmagnetic inorganic compound particle powder are used in a mixture, it is preferable that the magnetic iron compound particle powder be included at a mixing ratio of at least 30% by mass.

It is preferable that the magnetic iron compound particle powder be entirely or partially treated with a lipophilic agent.

In this case, an organic compound having one or two or more functional groups such as an epoxy group, an amino group, a mercapto group, an organic acid group, an ester group, a ketone group, a halogenated alkyl group and an aldehyde group, or a mixture of such organic compounds can be used for the lipophilic treatment.

The organic compound having a functional group is preferably a coupling agent, more preferably a silane coupling agent, a titanium coupling agent and an aluminum coupling agent, and a silane coupling agent is particularly preferable.

A thermosetting resin is preferable as a binder resin constituting the magnetic body-dispersed resin particle. For example, a phenol resin, an epoxy resin, an unsaturated polyester resin and the like can be used, but from the viewpoint of inexpensiveness and easiness of the production method, it is preferable that a phenol resin be included. For example, a phenol-formaldehyde resin can be mentioned.

The content ratio of the binder resin and the magnetic iron compound particle powder (or the mixture of the magnetic iron compound particle powder and the nonmagnetic inorganic compound particle powder) constituting the composite particle in the present invention is preferably from 1% by mass to 20% by mass of the binder resin and from 80% by mass to 99% by mass of the magnetic iron compound particle powder (or the mixture).

Next, a method for producing the magnetic body-dispersed resin particle will be described.

A phenol and an aldehyde are stirred in an aqueous medium in the presence of magnetic and nonmagnetic inorganic compound particle powders and a basic catalyst, for example, as indicated in Examples described hereinbelow. Then, the phenol and the aldehyde are reacted and cured to generate a composite particle including an inorganic compound particle such as magnetic iron particle powder and a phenol resin.

Moreover, the magnetic body-dispersed resin particle can be also manufactured by the so-called knead-pulverizing method by which a binder resin including inorganic compound particles such as magnetic iron oxide particle powder is pulverized. The former method is preferred because the particle diameter of the magnetic carrier can be easily controlled and a sharp particle diameter distribution can be obtained.

Next, a porous magnetic core particle will be described.

As a material of the porous magnetic core particle, magnetite or ferrite is preferable. Furthermore, ferrite is more preferable as the material of the porous magnetic core particle because the porous structure of the porous magnetic core particle can be controlled and the resistance can be adjusted.

Ferrite is a sintered body represented by a following general formula.

$$(M1_2O)_x(M2O)_y(Fe_2O_3)_z$$

(wherein, M1 is a monovalent metal, M2 is a divalent metal, and x and y each satisfy $0 \leq x \leq 0.8$ and $0 \leq y \leq 0.8$ where $x+y+z=1.0$, and z is $0.2<z<1.0$)

In the formula, at least one metal atom selected from the group consisting of Li, Fe, Mn, Mg, Sr, Cu, Zn, Ca is preferably used as M1 and M2. In addition, Ni, Co, Ba, Y, V, Bi, In, Ta, Zr, B, Mo, Na, Sn, Ti, Cr, Al, Si, rare earth elements and the like can be used.

In the magnetic carrier, it is preferable to maintain the appropriate amount of magnetization and to control the unevenness state of the surface of the porous magnetic core particle in order to bring the fine pore diameter into a desired range. In addition, it is preferable that the rate of the ferritization reaction could be easily controlled, and the specific resistance and magnetic force of the porous magnetic core could be suitably controlled. From the above viewpoints, a Mn-based ferrite, a Mn—Mg-based ferrite, a Mn—Mg—Sr-based ferrite, and a Li—Mn-based ferrite including a Mn element are more preferable. A manufacturing process implemented in the case of using a porous ferrite particle as a magnetic carrier core is explained hereinbelow in detail.

Step 1 (Weighing and Mixing Step)

The raw materials of the above ferrite are weighed and mixed.

The ferrite raw materials can be exemplified by metal particle of the abovementioned metal elements, or oxides, hydroxides, oxalates, carbonates and the like thereof.

Examples of an apparatus for mixing are presented hereinbelow. A ball mill, a planetary mill, a Giotto mill, and a vibration mill. In particular, a ball mill is preferable from the viewpoint of mixability.

Specifically, the weighed ferrite raw materials and balls are placed in a ball mill, and pulverized and mixed, preferably for 0.1 h to 20.0 h.

Step 2 (Pre-Baking Step)

The pulverized and mixed ferrite raw materials are pre-baked in the air or in a nitrogen atmosphere, preferably at a baking temperature of from 700° C. to 1200° C., preferably for 0.5 h to 5.0 h, to form a ferrite. For example, the following furnace is used for firing. A burner type baking furnace, a rotary type baking furnace, an electric furnace and the like.

Step 3 (Pulverization Step)

The pre-baked ferrite produced in step 2 is pulverized in a pulverizer.

The pulverizer is not particularly limited as long as a desired particle diameter can be obtained. For example, the following can be mentioned. A crusher, a hammer mill, a ball mill, a bead mill, a planetary mill, a Giotto mill and the like.

In order to obtain the desired particle diameter of the pulverized ferrite product, it is preferable to control the material of the balls or beads used in a ball mill or bead mill, the particle diameter, and the operation time. Specifically, in order to reduce the particle diameter of the pre-baked ferrite slurry, balls with a high specific gravity may be used or the pulverizing time may be lengthened. Moreover, in order to widen the particle size distribution of the pre-baked ferrite, balls or beads with a high specific gravity may be used or the pulverizing time can be lengthened. Also, by mixing a plurality of pre-baked ferrites different in particle diameter, it is possible to obtain a pre-baked ferrite having a wide distribution.

Further, in the ball mill and bead mill, a wet method is superior to a dry method in that the pulverized product does not fly up in the mill and the pulverizing efficiency is high. Therefore, the wet method is more preferable than the dry method.

Step 4 (Granulation Step)

Water, a binder and, if necessary, a pore regulator are added to the pulverized product of pre-baked ferrite. The pore regulator can be exemplified by a foaming agent and fine resin particles.

The foaming agent can be exemplified by sodium hydrogencarbonate, potassium hydrogencarbonate, lithium hydrogencarbonate, ammonium hydrogencarbonate, sodium carbonate, potassium carbonate, lithium carbonate, and ammonium carbonate.

The fine resin particles can be exemplified by polyesters, polystyrene, and styrene copolymers such as styrene-vinyl toluene copolymer, styrene-vinyl naphthalene copolymer, styrene-acrylic acid ester copolymer, styrene-methacrylic acid ester copolymer, styrene-α-chloromethacrylic acid, styrene-acrylonitrile copolymer, styrene-vinyl methyl ketone copolymer, styrene-butadiene copolymer, styrene-isoprene copolymer, styrene-acrylonitrile-indene copolymer and the like; polyvinyl chloride, phenol resins, modified phenol resins, maleic resins, acrylic resins, methacrylic resins, polyvinyl acetate, and silicone resins; polyester resins having monomers selected from aliphatic polyhydric alcohols, aliphatic dicarboxylic acids, aromatic dicarboxylic acids, aromatic dialcohols and diphenols as structural units; polyurethane resins, polyamide resins, polyvinyl butyral, terpene resins, coumarone indene resins, petroleum resins, and hybrid resins having a polyester unit and a vinyl polymer unit.

For example, polyvinyl alcohol can be used as the binder.

In step 3, in the case of wet pulverizing, it is preferable to add a binder and, if necessary, a pore regulator by taking into consideration the water contained in the ferrite slurry.

The obtained ferrite slurry is dried and granulated using a spray drying device, preferably in a heating atmosphere at from 100° C. to 200° C. The spray drying device is not particularly limited as long as the desired particle diameter of the porous magnetic core particles can be obtained. For example, a spray dryer can be used.

Step 5 (Main Baking Step)

Next, the granulated product is baked, preferably at 800° C. to 1400° C., and preferably for 1 h to 24 h.

By raising the baking temperature and prolonging the baking time, baking of the porous magnetic core particles is promoted, and as a result, the pore diameter is decreased and the number of pores is also reduced.

Step 6 (Sorting Step)

After pulverizing the baked particles as described above, if necessary, coarse particles or fine particles may be removed by classification or screening with a sieve.

From the viewpoint of suppression of carrier adhesion and attachment to an image, the volume distribution standard 50% particle diameter (D50) of the magnetic core particles is preferably from 18.0 μm to 68.0 μm.

Step 7 (Filling Step)

Depending on the pore volume thereinside, the porous magnetic core particle may have a low physical strength, and in order to increase the physical strength as a magnetic carrier, at least a part of the voids of the porous magnetic core particle is preferably filled with a resin. The amount of the resin filled in the porous magnetic core particles is preferably 2% by mass to 15% by mass in the porous magnetic core particles.

Provided that the spread in the resin amount for each magnetic carrier is small, the resin may be filled in only a part of the internal voids, the resin may be filled only in the voids near the surface of the porous magnetic core particle while the voids remain inside, or the internal voids may be completely filled with the resin.

A method for filling the resin in the voids of the porous magnetic core particles is not particularly limited. For example, a method can be used by which a porous magnetic core particle is impregnated with a resin solution by a coating method such as an immersion method, a spray method, a brushing method and a fluidized bed, and the solvent is thereafter evaporated. Further, a method can also be used by which a resin is diluted with a solvent and then added to the voids in the porous magnetic core particle.

The solvent used here may be any one that can dissolve the resin. When the resin is soluble in an organic solvent, examples of the organic solvent include toluene, xylene, cellosolve butyl acetate, methyl ethyl ketone, methyl isobutyl ketone and methanol. In the case of a water-soluble resin or an emulsion-type resin, water may be used as the solvent.

The amount of solid resin fraction in the resin solution is preferably 1% by mass to 50% by mass, and more preferably 1% by mass to 30% by mass. When the amount is 50% by mass or less, the viscosity is not too high, and the resin solution easily penetrates uniformly into the voids of the porous magnetic core particles. Meanwhile, when the amount is 1% by mass or more, the amount of resin is appropriate, and the adhesion of the resin to the porous magnetic core particle is improved.

Either a thermoplastic resin or a thermosetting resin may be used as a resin for filling the voids of the porous magnetic core particles. A resin with high affinity to the porous magnetic core particle is preferable. When a resin having high affinity is used, the surface of the porous magnetic core particle can be covered with the resin simultaneously with the filling of the resin into the voids of the porous magnetic core particle.

Examples of the thermoplastic resin as the resin to be filled are as follows. A novolak resin, a saturated alkyl polyester resin, a polyarylate, a polyamide resin, an acrylic resin and the like.

Examples of the thermosetting resin are as follows. A phenol resin, an epoxy resin, an unsaturated polyester resin, a silicone resin and the like.

Further, the magnetic carrier has a resin coating layer on the surface of the magnetic carrier core.

A method for coating the surface of the magnetic carrier core with a resin is not particularly limited, and examples thereof include a coating method by an immersion method, a spray method, a brush coating method, a dry method, and a fluidized bed.

Further, conductive particles and particles and materials having charge controllability may be contained in the resin coating layer. Examples of conductive particles include carbon black, magnetite, graphite, zinc oxide and tin oxide.

The amount of conductive particles added is preferably 0.1 parts by mass to 10.0 parts by mass with respect to 100 parts by mass of the coating resin in order to adjust the resistance of the magnetic carrier.

Examples of particles having charge controllability include particles of organic metal complexes, particles of organic metal salts, particles of chelate compounds, particles of monoazo metal complexes, particles of acetylacetone metal complexes, particles of hydroxycarboxylic acid metal complexes, particles of polycarboxylic acid metal complexes, particles of polyol metal complexes, particles of polymethyl methacrylate resin, particles of polystyrene resin, particles of melamine resin, particles of phenol resin, particles of nylon resin, particles of silica, particles of titanium oxide, particles of alumina and the like.

The addition amount of the particles having charge controllability is preferably 0.5 parts by mass to 50.0 parts by mass with respect to 100 parts by mass of the coating resin in order to adjust the triboelectric charge quantity.

Next, the preferred toner configuration is described in detail below.

The toner has a toner particle including a binder resin and, as necessary, a colorant and a release agent. The binder resin may be exemplified by a vinyl resin, a polyester resin, an epoxy resin and the like. Among them, a vinyl resin and a polyester resin are more preferable in terms of charging performance and fixability. A polyester resin is particularly preferred.

Homopolymers or copolymers of vinyl monomers, polyesters, polyurethanes, epoxy resins, polyvinyl butyral, rosins, modified rosins, terpene resins, phenol resins, aliphatic or alicyclic hydrocarbon resins, aromatic petroleum resins, and the like can be used, if necessary, by mixing with the binder resin.

When two or more kinds of resins are mixed and used as a binder resin, in a more preferable embodiment, it is preferable that the resins having different molecular weights be mixed in a suitable proportion.

The glass transition temperature of the binder resin is preferably from 45° C. to 80° C., and more preferably from 55° C. to 70° C. The number average molecular weight (Mn)

is preferably from 2500 to 50000. The weight average molecular weight (Mw) is preferably from 10000 to 1000000.

The following polyester resins are also preferable as the binder resin.

It is preferable that from 45 mol % to 55 mol % be an alcohol component, and from 45 mol % to 55 mol % be an acid component, based on the total monomer units which constitute a polyester resin.

The acid value of the polyester resin is preferably from 0 mg KOH/g to 90 mg KOH/g, and more preferably from 5 mg KOH/g to 50 mg KOH/g. The hydroxyl value of the polyester resin is preferably from 0 mg KOH/g to 50 mg KOH/g, and more preferably from 5 mg KOH/g to 30 mg KOH/g. This is because when the number of end groups of the molecular chain increases, the charging characteristics of the toner become more dependent on the environment.

The glass transition temperature of the polyester resin is preferably from 50° C. to 75° C., and more preferably from 55° C. to 65° C. The number average molecular weight (Mn) is preferably from 1500 to 50000, and more preferably from 2000 to 20000. The weight average molecular weight (Mw) is preferably from 6000 to 100000, and more preferably from 10000 to 90000.

A crystalline polyester resin such as described below may be added to the toner for the purpose of promoting the plasticizing effect of the toner and improving the low-temperature fixability.

Examples of crystalline polyesters include polycondensates of monomer compositions including an aliphatic diol having from 2 to 22 carbon atoms and an aliphatic dicarboxylic acid having from 2 to 22 carbon atoms as the main components.

The aliphatic diol having from 2 to 22 carbon atoms (more preferably from 6 to 12 carbon atoms) is not particularly limited, but is preferably a chain (more preferably linear) aliphatic diol. Among these, particularly preferred are linear aliphatics such as ethylene glycol, diethylene glycol, 1,4-butanediol and 1,6-hexanediol, and also α, ω-diols.

Among the alcohol components, preferably 50% by mass or more, and more preferably 70% by mass or more is an alcohol selected from aliphatic diols having from 2 to 22 carbon atoms.

A polyhydric alcohol monomer other than aliphatic diols can also be used. Examples of the dihydric alcohol monomer include aromatic alcohols such as polyoxyethylenated bisphenol A, polyoxypropyleneated bisphenol A and the like; 1,4-cyclohexanedimethanol and the like.

Examples of trivalent or higher polyhydric alcohol monomers include aromatic alcohols such as 1,3,5-trihydroxymethylbenzene and the like; aliphatic alcohols such as pentaerythritol, dipentaerythritol, tripentaerythritol, 1,2,4-butanetriol, 1,2,5-pentanetriol, glycerin, 2-methylpropanetriol, 2-methyl-1,2,4-butanetriol, trimethylolethane, trimethylolpropane and the like; and the like.

Furthermore, a monovalent alcohol may be used to such an extent that the properties of the crystalline polyester are not impaired.

Meanwhile, the aliphatic dicarboxylic acid having from 2 to 22 carbon atoms (more preferably from 6 to 12 carbon atoms) is not particularly limited, but is preferably a chain (more preferably linear) aliphatic dicarboxylic acid. Compounds obtained by hydrolyzing acid anhydrides or lower alkyl esters thereof are also included.

Among the carboxylic acid components, preferably 50% by mass or more, and more preferably 70% by mass or more is a carboxylic acid selected from aliphatic dicarboxylic acids having from 2 to 22 carbon atoms.

A polyvalent carboxylic acid other than the above-mentioned aliphatic dicarboxylic acids having from 2 to 22 carbon atoms can also be used. Examples of divalent carboxylic acids include aromatic carboxylic acids such as isophthalic acid, terephthalic acid and the like; aliphatic carboxylic acids such as n-dodecylsuccinic acid, n-dodecenylsuccinic acid and the like; and alicyclic carboxylic acids such as cyclohexanedicarboxylic acid and the like. Anhydrides or lower alkyl esters thereof are also included.

Examples of trivalent and higher polyvalent carboxylic acids include aromatic carboxylic acids such as 1,2,4-benzenetricarboxylic acid (trimellitic acid), 2,5,7-naphthalenetricarboxylic acid, 1,2,4-naphthalenetricarboxylic acid, pyromellitic acid and the like; and aliphatic carboxylic acids such as 1,2,4-butanetricarboxylic acid, 1,2,5-hexanetricarboxylic acid, 1,3-dicarboxyl-2-methyl-2-methylenecarboxypropane and the like. Derivatives and the like thereof such as anhydrides and lower alkyl esters are also included.

Furthermore, a monovalent monohydric carboxylic acid may be also included to such an extent that the characteristics of the crystalline polyester are not impaired.

The crystalline polyester can be produced according to a conventional polyester synthesis method. For example, after the esterification reaction or transesterification reaction of the abovementioned carboxylic acid monomer and alcohol monomer, a desired crystalline polyester is obtained by polycondensation reaction according to a conventional method under reduced pressure or by introducing nitrogen gas.

The amount of the crystalline polyester used is preferably from 0.1 parts by mass to 30 parts by mass, and more preferably from 0.5 parts by mass to 20 parts by mass with respect to 100 parts by mass of the binder resin. Even more preferably, this amount is from 3 parts by mass to 15 parts by mass.

The toner may contain colorant. Examples of the colorant are as follows.

Examples of the black colorant include carbon black and those adjusted to black using a yellow colorant, a magenta colorant and a cyan colorant.

Examples of color pigments for a magenta toner are as follows. Condensed azo compounds, diketopyrrolopyrrole compounds, anthraquinone compounds, quinacridone compounds, basic dye lake compounds, naphthol compounds, benzimidazolone compounds, thioindigo compounds and perylene compounds. Specific examples include C. I. Pigment Red 1, 2, 3, 4, 5, 6, 7, 8, 9, 10, 11, 12, 13, 14, 15, 16, 17, 18, 19, 21, 22, 22, 23, 30, 31, 32, 37, 38, 39, 40, 41, 48:2, 48:3, 48:4, 49, 50, 51, 52, 53, 54, 55, 57:1, 58, 60, 63, 64, 68, 81:1, 83, 87, 88, 89, 90, 112, 114, 122, 123, 144, 146, 150, 163, 166, 169, 177, 184, 185, 202, 206, 207, 209, 220, 221, 238, 254, 269; C. I. Pigment Violet 19, and C. I. Vat Red 1, 2, 10, 13, 15, 23, 29, 35.

Although a pigment may be used alone as a colorant, it is preferable from the viewpoint of the image quality of a full color image to improve the definition by using a dye and a pigment in combination.

Examples of the magenta toner dye are as follows. Oil-soluble dyes such as C. I. Solvent Red 1, 3, 8, 23, 24, 25, 27, 30, 49, 81, 82, 83, 84, 100, 109, 121, C. I. Disperse Read 9, C. I. Solvent Violet 8, 13, 14, 21, 27, and C. I. Disperse Violet 1, and basic dyes such as C. I. Basic Red 1, 2, 9, 12, 13, 14, 15, 17, 18, 22, 23, 24, 27, 29, 32, 34, 35, 36, 37, 38, 39, 40, C. I. Basic Violet 1, 3, 7, 10, 14, 15, 21, 25, 26, 27, 28 and the like.

Examples of the color pigment for a cyan toner are as follows. C. I. Pigment Blue 1, 2, 3, 7, 15:2, 15:3, 15:4, 16, 17, 60, 62, 66; C. I. Vat Blue 6, C. I. Acid Blue 45, and copper phthalocyanine pigments in which from 1 to 5 phthalimidomethyl groups are substituted in the phthalocyanine skeleton.

Examples of color pigments for a yellow toner are as follows. Condensed azo compounds, isoindolinone compounds, anthraquinone compounds, azo metal compounds, methine compounds, allylamide compounds.

Specific examples include C. I. Pigment Yellow 1, 2, 3, 4, 5, 6, 7, 10, 11, 12, 13, 14, 15, 16, 17, 23, 62, 65, 73, 74, 83, 93, 95, 97, 109, 110, 111, 120, 127, 128, 129, 147, 155, 168, 174, 180, 181, 185, 191; and C. I. Vat Yellow 1, 3, 20. Dyes such as C. I. Direct Green 6, C. I. Basic Green 4, C. I. Basic Green 6, Solvent Yellow 162 and the like can also be used.

The amount of the colorant used is preferably from 0.1 parts by mass to 30 parts by mass, more preferably from 0.5 parts by mass to 20 parts by mass, and further preferably from 3 parts by mass to 15 parts by mass with respect to 100 parts by mass of the binder resin.

A method for producing the toner is not particularly limited, and any known method can be used. For example, a melt-kneading method, a suspension polymerization method, a dissolution suspension method, an emulsion aggregation method and the like can be mentioned.

In the toner, it is preferable to use a binder resin in which a colorant is mixed in advance to make a master batch. Then, the colorant can be well dispersed in the toner by melt-kneading the colorant master batch and other raw materials (binder resin, wax and the like).

A charge control agent can be used, as necessary, to further stabilize the charging performance of the toner. The charge control agent is preferably used in an amount of 0.5 parts by mass to 10 parts by mass per 100 parts by mass of the binder resin. When the amount is 0.5 parts by mass or more, sufficient charging characteristics can be obtained. Meanwhile, when the amount is 10 parts by mass or less, the compatibility with other materials becomes satisfactory, and excessive charging under low humidity can be suppressed.

Examples of the charge control agent are as follows.

For example, an organic metal complex or a chelate compound is effective as a negative charging control agent which controls the toner to be negatively chargeable. Examples thereof include monoazo metal complexes, metal complexes of aromatic hydroxycarboxylic acids, and metal complexes of aromatic dicarboxylic acids. Other examples include aromatic hydroxycarboxylic acids, aromatic mono- and polycarboxylic acids and metal salts thereof, anhydrides thereof, or esters thereof, or phenol derivatives such as bisphenol.

Examples of positive charging control agents that control the toner to be positively chargeable include modified products of nigrosine and fatty acid metal salts, quaternary ammonium salts such as tributylbenzylammonium-1-hydroxy-4-naphthosulfonate, tetrabutylammonium tetrafluoroborate, and the like, onium salts such as phosphonium salts which are analogues thereof, and chelate pigments thereof, triphenylmethane dyes and lake pigments thereof (examples of lake forming agents include phosphotungstic acid, phosphomolybdic acid, phosphotungsten-molybdic acid, tannic acids, lauric acid, gallic acid, ferricyanic acid, ferrocyanide compounds and the like), and examples of metal salts of higher aliphatic acids include diorganotin oxides such as dibutyltin oxide, dioctyltin oxide, dicyclohexyltin oxide and the like, diorganotin borates such as dibutyltin borate, dioctyltin borate, dicyclohexyl tin borate and the like.

If necessary, one or two or more release agents may be contained in the toner particles. The following can be mentioned as a release agent.

Aliphatic hydrocarbon waxes such as low molecular weight polyethylene, low molecular weight polypropylene, microcrystalline wax and paraffin wax can be preferably used. Other examples include oxides of aliphatic hydrocarbon waxes, such as oxidized polyethylene wax, or block copolymers thereof; waxes mainly composed of fatty acid esters such as carnauba wax, sasol wax, montanic acid ester wax and the like; and partially or entirely deoxidized fatty acid esters such as deoxidized carnauba wax and the like.

The amount of the release agent is preferably from 0.1 parts by mass to 20 parts by mass, and more preferably from 0.5 parts by mass to 10 parts by mass with respect to 100 parts by mass of the binder resin.

Moreover, it is preferable that a melting point of a release agent defined by a maximum endothermic peak temperature at the time of temperature rise measured with a differential scanning calorimeter (DSC) be from 65° C. to 130° C., and more preferably from 80° C. to 125° C. When the melting point is 65° C. or more, the viscosity of the toner is suitable, so that the toner adhesion to the photosensitive member can be suppressed. Meanwhile, when the melting point is 130° C., the low-temperature fixability is improved.

Fine powder that, when externally added to the toner particles, can increase the flowability as compared with that before the addition can be used as a flowability improver of the toner. Examples of suitable fine powders include fluororesin powder such as fine powder of vinylidene fluoride and fine powder of polytetrafluoroethylene; and finely powdered silica such as wet method silica and dry method silica, finely powdered titanium oxide, finely powdered alumina, and the like, subjected to surface treatment and hydrophobized with a silane coupling agent, a titanium coupling agent or silicone oil, and those treated so that the degree of hydrophobization measured by a methanol titration test exhibits a value in the range of from 30 to 80 are particularly preferable.

The inorganic fine particles are preferably used in an amount of from 0.1 parts by mass to 10 parts by mass, and more preferably from 0.2 parts by mass to 8 parts by mass with respect to 100 parts by mass of toner particles.

The two-component developer of the present invention includes a toner having a toner particle including a binder resin, and a magnetic carrier.

When the toner is mixed with the magnetic carrier, the toner concentration is preferably from 2% by mass to 15% by mass, and more preferably from 4% by mass to 13% by mass, and satisfactory results are usually obtained in these ranges. When the toner concentration is 2% by mass or more, the image density is satisfactory, and when the toner concentration is 15% by mass or less, fogging and scattering inside the machine can be suppressed.

The two-component developer including the magnetic carrier of the present invention can be used in an image forming method which comprises:

a charging step of charging an electrostatic latent image bearing member;

an electrostatic latent image forming step of forming an electrostatic latent image on a surface of the electrostatic latent image bearing member;

a developing step of developing the electrostatic latent image by using a two-component developer in a developing device to form a toner image;

a transfer step of transferring the toner image to a transfer material with or without an intermediate transfer member; and a fixing step of fixing the transferred toner image to the transfer material.

The image forming method may have a configuration such that the two-component developer is contained in a developing device, and a replenishing developer is supplied to the developing device according to the reduction of the toner concentration of the two-component developer in the developing device. The magnetic carrier of the present invention can be used in the replenishing developer for use in such an image forming method. The image forming method may also have a configuration in which excess magnetic carrier in the developing device is discharged from the developing device as needed.

The replenishing developer preferably includes a magnetic carrier, and a toner having a toner particle including a binder resin and, if necessary, a colorant and a release agent. The replenishing developer preferably includes from 2 parts by mass to 50 parts by mass of the toner with respect to 1 part by mass of the replenishing magnetic carrier. The replenishing developer may be only the toner, without having the replenishing magnetic carrier.

Next, an image forming apparatus provided with a developing device using a magnetic carrier, a two-component developer and a replenishing developer will be described by way of example, but the present invention is not limited thereto.

Image Forming Method

In FIG. 1, an electrostatic latent image bearing member 1 rotates in the direction of the arrow in the figure. The electrostatic latent image bearing member 1 is charged by a charger 2, which is a charging unit, and the surface of the charged electrostatic latent image bearing member 1 is exposed by an exposure unit 3, which is an electrostatic latent image forming unit, to form an electrostatic latent image. The developing device 4 has a developing container 5 for containing a two-component developer, the developer carrying member 6 is rotatably disposed, and magnets 7 are enclosed as a magnetic field generating means inside the developer carrying member 6. At least one of the magnets 7 is installed so as to face the latent image bearing member.

The two-component developer is held on the developer carrying member 6 by the magnetic field of the magnet 7, the amount of the two-component developer is regulated by a regulating member 8, and the two-component developer is transported to a developing unit facing the electrostatic latent image bearing member 1. In the developing unit, a magnetic brush is formed by the magnetic field generated by the magnet 7. Thereafter, the electrostatic latent image is visualized as a toner image by applying a developing bias in which an alternating electric field is superimposed on a DC electric field. The toner image formed on the electrostatic latent image bearing member 1 is electrostatically transferred to a recording medium 12 by a transfer charger 11.

Figure 2:
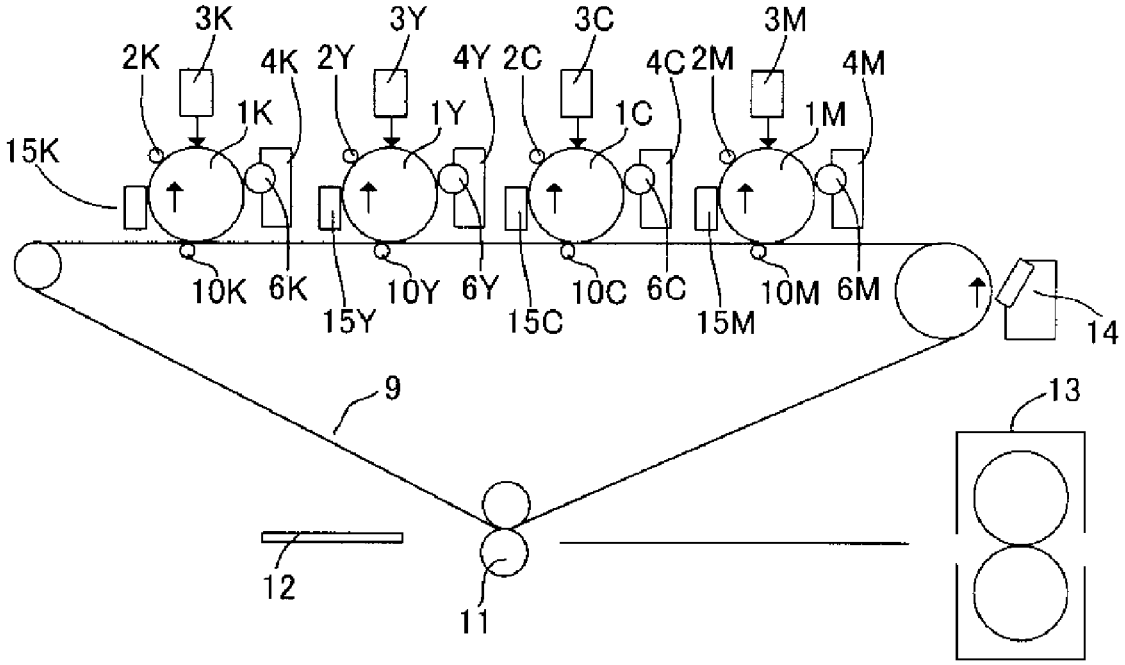
FIG. 2 is a schematic view of an image forming apparatus.

Here, as shown in FIG. 2, the latent image may be temporarily transferred from the electrostatic latent image bearing member 1 to an intermediate transfer member 9 and then electrostatically transferred to a transfer material (recording medium) 12. Thereafter, the recording medium 12 is transported to a fixing device 13, where the toner is fixed on the recording medium 12 by being heated and pressed. Thereafter, the recording medium 12 is discharged as an output image out of the apparatus. After the transfer step, the toner remaining on the electrostatic latent image bearing member 1 is removed by a cleaner 15.

Thereafter, the electrostatic latent image bearing member 1 cleaned by the cleaner 15 is electrically initialized by light irradiation from a pre-exposure 16, and the image forming operation is repeated.

FIG. 2 shows an example of a full color image forming apparatus.

The arrows indicating the arrangement of the image forming units such as K, Y, C, M, and the like and the rotation direction in the figure are not limited to those shown in the figure. Here, K means black, Y means yellow, C means cyan, and M means magenta. In FIG. 2, electrostatic latent image bearing members 1K, 1Y, 1C, 1M rotate in the direction of the arrow in the figure. Each electrostatic latent image bearing member is charged by charging units 2K, 2Y, 2C, 2M as charging means, and on the surface of each electrostatic latent image bearing member that has been charged, exposure is performed with exposure units 3K, 3Y, 3C, 3M as electrostatic latent image forming means to form an electrostatic latent image.

After that, the electrostatic latent image is visualized as a toner image by the two-component developers carried on the developer carrying members 6K, 6Y, 6C, 6M provided in the developing units 4K, 4Y, 4C, 4M, which are developing means. Further, the toner image is transferred to the intermediate transfer member 9 by intermediate transfer chargers 10K, 10Y, 10C, 10M which are transfer means. Further, the image is transferred to the recording medium 12 by the transfer charger 11, which is a transfer means, and the recording medium 12 is outputted as an image after heating and pressurizing with the fixing device 13 which is a fixing means. Then, the intermediate transfer member cleaner 14, which is a cleaning member of the intermediate transfer member 9, recovers the transfer residual toner and the like.

As a developing method, specifically, it is preferable to perform development in a state in which the magnetic brush is in contact with the photosensitive member while applying an alternating voltage to the developer carrying member to form an alternating electric field in the development region. The distance (S-D distance) between the developer carrying member (developing sleeve) 6 and a photosensitive drum of from 100 μm to 1000 μm is satisfactory in preventing carrier adhesion and improving dot reproducibility. Where the distance is 100 μm or more, the supply of the developer is sufficient and the image density is satisfactory. When the distance is 1000 μm or less, magnetic lines from the magnetic pole S1 are unlikely to spread, the density of the magnetic brush becomes satisfactory, and dot reproducibility is improved. In addition, a force restraining the magnetic carrier is increased, and the carrier adhesion can be suppressed.

The voltage (Vpp) between the peaks of the alternating electric field is preferably from 300 V to 3000 V, and more preferably from 500 V to 1800 V. The frequency is preferably from 500 Hz to 10000 Hz, and more preferably from 1000 Hz to 7000 Hz, and can be appropriately selected and used according to the process.

In this case, the waveform of the AC bias for forming the alternating electric field can be exemplified by a triangular wave, a rectangular wave, a sine wave, and a waveform in which the Duty ratio is changed. At the same time, in order to cope with changes in the formation speed of toner images, it is preferable to perform development by applying a developing bias voltage (intermittent alternating superimposed voltage) having a discontinuous AC bias voltage to the developer carrying member. When the applied voltage is 300 V or more, sufficient image density can be easily obtained, and the fog toner in the non-image area can be easily recovered. When the voltage is 3000 V or less, disturbance of the latent image through the magnetic brush is unlikely to occur, and a satisfactory image quality can be obtained.

By using a two-component developer having a toner that has been satisfactorily charged, it is possible to lower the fog removal voltage (Vback) and reduce the primary charge of the photosensitive member, thereby prolonging the life of the photosensitive member. Vback depends on the development system, but is preferably 200 V or less, and more preferably 150 V or less. A potential from 100 V to 400 V is preferably used as a contrast potential so that sufficient image density could be obtained.

Where the frequency is lower than 500 Hz, the electrostatic latent image-bearing member may have the same configuration as the photosensitive member usually used in image forming apparatuses, although the specific configuration is correlated with the process speed. For example, the photosensitive member can be configured by providing a conductive layer, an undercoat layer, a charge generation layer, a charge transport layer, and, if necessary, a charge injection layer in the order of description on a conductive substrate such as aluminum or SUS.

The conductive layer, the undercoat layer, the charge generation layer, and the charge transport layer may be those generally used for a photosensitive member. For example, a charge injection layer or a protective layer may be used as the outermost surface layer of the photosensitive member.

Hereafter, methods for measuring the physical properties relating to the present invention are described.

Method for Measuring Volume Average Particle Diameter (D50) of Magnetic Carrier and Porous Magnetic Core The particle size distribution is measured by a laser diffraction/scattering type particle size distribution measuring apparatus "MICROTRAC MT3300EX" (manufactured by Nikkiso Co., Ltd.).

The measurement of the volume average particle diameter (D50) of the magnetic carrier and porous magnetic core is carried out by attaching a sample feeder for dry measurement "One-shot dry type sample conditioner Turbotrac" (manufactured by Nikkiso Co., Ltd.). The supply conditions of Turbotrac are as follows: a dust collector is used as a vacuum source, the air volume is about 33 L/sec, and the pressure is about 17 kPa. Control is performed automatically on software. As the particle diameter, a 50% particle diameter (D50), which is a cumulative value of volume average, is determined. Control and analysis are performed using provided software (version 10.3.3-202D). The measurement conditions are as follows.

SetZero time: 10 sec
Measurement time: 10 sec
Number of measurements: 1 cycle
Particle refractive index: 1.81%
Particle shape: non-spherical
Upper limit of measurement: 1408 μm
Lower limit of measurement: 0.243 μm
Measurement environment: 23° C., 50% RH Measurement of Amount of Polymer Having Structure Represented by Formula (1) in Resin Coating Layer of Magnetic Carrier The resin coating layer can be separated from the magnetic carrier and the amount of the polymer having a structure represented by the formula (1) can be measured by the following method. A method of taking the magnetic carrier in a cup and eluting the coating resin with toluene can be used for separating the resin coating layer from the magnetic carrier.

Dissolution in chloroform-D and measurement of $^{13}$C-NMR are performed after removing toluene.

Method for Measuring Weight Average Particle Diameter (D4) and Number Average Particle Diameter (D1)

The weight average particle diameter (D4) and number average particle diameter (D1) of the toner were determined using a precision particle size distribution measuring apparatus (registered trademark, "Coulter Counter Multisizer 3", manufactured by Beckman Coulter, Inc.) based on a pore electric resistance method and equipped with an aperture tube having a diameter of 100 μm and dedicated software "Beckman Coulter Multi sizer 3 Version 3.51" (manufactured by Beckman Coulter, Inc.) which is provided with the apparatus and used to set the measurement conditions and analyze the measurement data. The measurement was performed with 25,000 effective measurement channels, and the measurement data were analyzed and calculated.

A solution prepared by dissolving special grade sodium chloride in ion exchanged water to a concentration of about 1% by mass, for example, "ISOTON II" (trade name) manufactured by Beckman Coulter, Inc., can be used as the electrolytic aqueous solution to be used for measurements.

The dedicated software is set up in the following manner before the measurement and analysis.

The total count number in a control mode is set to 50,000 particles on a "CHANGE STANDARD MEASUREMENT METHOD (SOM) SCREEN" of the dedicated software, the number of measurements is set to 1, and a value obtained using "standard particles 10.0 μm" (manufactured by Beckman Coulter, Inc.) is set as a Kd value. The threshold and the noise level are automatically set by pressing a measurement button of threshold/noise level. Further, the current is set to 1600 μA, the gain is set to 2, the electrolytic solution is set to ISOTON II (trade name), and flush of aperture tube after measurement is checked.

In the "PULSE TO PARTICLE DIAMETER CONVERSION SETTING SCREEN" of the dedicated software, the bin interval is set to a logarithmic particle diameter, the particle diameter bin is set to a 256-particle diameter bin, and a particle diameter range is set from 2 μm to 60 μm.

A specific measurement method is described hereinbelow.

(1) Approximately 200 mL of the electrolytic aqueous solution is placed in a glass 250 mL round-bottom beaker dedicated to Multisizer 3, the beaker is set in a sample stand, and stirring with a stirrer rod is carried out counterclockwise at 24 rpm. Dirt and air bubbles in the aperture tube are removed by the "FLUSH OF APERTURE TUBE" function of the dedicated software.

(2) A total of 30 mL of the electrolytic aqueous solution is placed in a glass 100 mL flat-bottom beaker. Then, about 0.3 mL of a diluted solution obtained by 3-fold mass dilution of "CONTAMINON N" (trade name) (10% by mass aqueous solution of a neutral detergent for washing precision measuring instruments of pH 7 consisting of a nonionic surfactant, an anionic surfactant, and an organic builder, manufactured by Wako Pure Chemical Industries, Ltd.) with ion exchanged water is added as a dispersing agent thereto.

(3) A predetermined amount of ion exchanged water is placed in the water tank of an ultrasonic disperser "Ultrasonic Dispersion System Tetora 150" (manufactured by Nikkaki Bios Co., Ltd.) with an electrical output of 120 W in which two oscillators with an oscillation frequency of 50 kHz are built in with a phase shift of 180 degrees is prepared. About 2 mL of the CONTAMINON N is added to the water tank.

(4) The beaker of (2) hereinabove is set in the beaker fixing hole of the ultrasonic disperser, and the ultrasonic disperser is actuated. Then, the height position of the beaker is adjusted so that the resonance state of the liquid surface of the electrolytic aqueous solution in the beaker is maximized.

(5) About 10 mg of the toner is added little by little to the electrolytic aqueous solution and dispersed therein in a state in which the electrolytic aqueous solution in the beaker of (4) hereinabove is irradiated with ultrasonic waves. Then, the ultrasonic dispersion process is further continued for 60 sec. In the ultrasonic dispersion, the water temperature in the water tank is appropriately adjusted to a temperature from 10° C. to 40° C.

(6) The electrolytic aqueous solution of (5) hereinabove in which the toner is dispersed is dropped using a pipette into the round bottom beaker of (1) hereinabove which has been set in the sample stand, and the measurement concentration is adjusted to be about 5%. Then, measurement is conducted until the number of particles to be measured reaches 50,000.

(7) The measurement data are analyzed with the dedicated software provided with the apparatus, and the weight average particle diameter (D4) and the number average particle diameter (D1) are calculated. The "AVERAGE DIAMETER" on the analysis/volume statistical value (arithmetic mean) screen when the dedicated software is set to graph/volume % is the weight average particle diameter (D4). The "AVERAGE DIAMETER" on the analysis/number statistical value (arithmetic mean) screen when the dedicated software is set to graph/number % is the number average particle diameter (D1).

Method for Calculating Fine Powder Amount

The fine powder amount (number %) based on the number of particles in the toner is calculated as follows.

For example, after measuring with the above Multisizer 3, the number % of particles equal to or less than 3.0 μm in the toner is calculated as follows. (1) The dedicated software is set to graph/number % and the chart of the measurement results is displayed as number %. (2) In the particle diameter setting portion on the form/particle diameter/particle diameter statistics screen, "<" is checked, and "3" is inputted to the particle diameter input portion therebelow. Then, (3) the numerical value on the "<3 μm" display part when the analysis/number statistical value (arithmetic mean) screen is displayed is the number % of particles equal to or less than 3.0 μm in the toner.

Method for Calculating Coarse Powder Amount

The coarse powder amount (volume %) based on the volume in the toner is calculated as follows.

For example, after measuring with the above Multisizer 3, the volume % of particles equal to or greater than 10.0 μm in the toner is calculated as follows. (1) The dedicated software is set to graph/volume % and the chart of the measurement results is displayed as volume %. (2) In the particle diameter setting portion on the form/particle diameter/particle diameter statistics screen, ">" is checked, and "10" is inputted to the particle diameter input portion therebelow. Then, (3) the numerical value on the ">10 μm" display part when the analysis/volume statistical value (arithmetic mean) screen is displayed is the volume % of particles equal to or greater than 10.0 μm in the toner.

Measurement of Weight Average Molecular Weight Mw of Coating Resin

The resin coating layer can be separated from the magnetic carrier by taking the magnetic carrier in a cup and eluting the coating resin with toluene.

The eluted resin is dried and then dissolved in tetrahydrofuran (THF) and measured using the following apparatus.

A sample (the coating resin or the coating resin separated from the magnetic carrier) and tetrahydrofuran (THF) are mixed at a concentration of 5 mg/ml and allowed to stand at room temperature for 24 h to dissolve the sample in THF. Thereafter, the solution that has passed through a sample-treated filter (Myshori Disc H-25-2, manufactured by Tosoh Corporation) is taken as a GPC sample.

Next, using a GPC measurement apparatus (HLC-8120GPC manufactured by Tosoh Corporation), measurement is performed under the following measurement conditions according to the operation manual of the apparatus.

Measurement Conditions

Device: high-speed GPC "HLC 8120 GPC" (manufactured by Tosoh Corporation)

Column: 7 series of Shodex KF-801, 802, 803, 804, 805, 806, 807 (manufactured by Showa Denko K. K.)

Eluent: THF

Flow velocity: 1.0 ml/min

Oven temperature: 40.0° C.

Sample injection volume: 0.10 ml

Further, when calculating the weight average molecular weight (Mw) and peak molecular weight (Mp) of the sample, the calibration curve is a molecular weight calibration curve created with standard polystyrene resins (TSK standard polystyrene F-850, F-450, F-288, F-128, F-80, F-40, F-20, F-10, F-4, F-2, F-1, A-5000, A-2500, A-1000, A-500, manufactured by Tosoh Corporation).

EXAMPLES

The present invention will be described hereinbelow in greater detail by way of the examples, but the present invention is not limited thereto. In the formulations hereinbelow, parts are based on mass unless stated otherwise.

Production Examples of Resins A-1 to A-14

The raw materials listed in Table 1 (total 100.0 parts) were added to a four-necked flask equipped with a reflux condenser, a thermometer, a nitrogen suction tube, and a rubbing-type stirring device, and further 200.0 parts of toluene, 200.0 parts of methyl ethyl ketone and 4.0 parts of azobisisovaleronitrile were added, and the system was kept under nitrogen stream at 80° C. for 10 h to obtain a coating resin A-1 solution (solid fraction: 20% by mass).

Coating resins A-2 to A-14 were obtained in the same manner except that the raw materials listed in Table 1 were used and the reaction time and temperature were adjusted. Physical properties are shown in Table 1.

TABLE 1

| | CHDMMA | MMA | St | 2HEMA | MA | Macromonomer MMA | Mw |
|---|---|---|---|---|---|---|---|
| Resin A-1 | 50 | 10 | 20 | | | 20 | 52,000 |
| Resin A-2 | 50 | | 20 | 10 | | 20 | 65,000 |
| Resin A-3 | 50 | 10 | | 20 | | 20 | 36,000 |
| Resin A-4 | 50 | | 30 | | | 20 | 87,000 |
| Resin A-5 | 50 | | 50 | | | | 45,000 |
| Resin A-6 | 50 | 50 | | | | | 43,000 |
| Resin A-7 | 70 | | 30 | | | | 69,000 |
| Resin A-8 | 30 | | 65 | | 5 | | 35,000 |
| Resin A-9 | 90 | 10 | | | | | 54,000 |
| Resin A-10 | 10 | 20 | 70 | | | | 36,000 |
| Resin A-11 | 95 | 5 | | | | | 47,000 |
| Resin A-12 | 5 | 20 | 75 | | | | 65,000 |
| Resin A-13 | 98 | 2 | | | | | 91,000 |
| Resin A-14 | 3 | 67 | 30 | | | | 31,000 |

In the table, the numerical value of each material indicates the number of parts. The abbreviations in the table are as follows.

CHDMMA: 1,4-cyclohexanedimethanol monoacrylate, MMA: methyl methacrylate, St: styrene, 2HEMA: 2-hydroxyethyl methacrylate, MA: methacrylic acid The macromonomer MMA is represented by the following formula (M). Z in the formula (M) is a methyl methacrylate polymer represented by the following structure (Z), and the weight average molecular weight Mw of the macromonomer MMA is 5000.

(M)

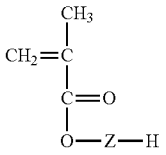

(Z)

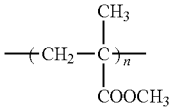

Production Example of Magnetic Carrier Core 1

Step 1 (Weighing and Mixing Step)

| | |
|---|---|
| $Fe_2O_3$ | 68.3% by mass |
| $MnCO_3$ | 28.5% by mass |
| $Mg(OH)_2$ | 2.0% by mass |
| $SrCO_3$ | 1.2% by mass |

The ferrite raw materials were weighed, 20 parts of water was added to 80 parts of the ferrite raw materials, and then wet mixing was performed with a ball mill using zirconia having a diameter (ϕ) of 10 mm for 3 h to prepare a slurry. The solid fraction concentration of the slurry was 80% by mass.

Step 2 (Pre-Baking Step)

The mixed slurry was dried by a spray dryer (manufactured by Ohkawara Kakohki Co., Ltd.), and then baked for 3.0 h at a temperature of 1050° C. in a nitrogen atmosphere (oxygen concentration 1.0% by volume) in a batch electric furnace to produce a pre-baked ferrite.

Step 3 (Pulverization Step)

After the pre-baked ferrite was pulverized to about 0.5 mm with a crusher, water was added to prepare a slurry. The solid fraction concentration of the slurry was 70% by mass. Pulverization was then performed for 3 h in a wet ball mill using ⅛ inch stainless steel beads to obtain a slurry. The slurry was then pulverized for 4 h in a wet bead mill using zirconia with a diameter of 1 mm to obtain a pre-baked ferrite slurry having a 50% particle diameter (D50) of 1.3 μm on a volume basis.

Step 4 (Granulation Step)

After adding 1.0 part of ammonium polycarboxylate as a dispersant and 1.5 parts of polyvinyl alcohol as a binder to 100 parts of the pre-baked ferrite slurry, pulverization and drying were performed with a spray dryer (manufactured by Ohkawara Kakohki Co., Ltd.) to obtain spherical particles. The obtained granulated product was adjusted in particle size, and then heated at 700° C. for 2 h by using a rotary electric furnace to remove organic substances such as the dispersant, the binder and the like.

Step 5 (Baking Step)

Baking was performed in a nitrogen atmosphere (oxygen concentration: 1.0% by volume) by setting the time from room temperature to the baking temperature (1100° C.) to 2 h and holding at a temperature of 1100° C. for 4 h. Thereafter, the temperature was lowered to 60° C. over 8 h, the nitrogen atmosphere was returned to the air atmosphere, and the particles were removed at a temperature of 40° C. or less.

Step 6 (Sorting Step)

After the aggregated particles were disintegrated, sieving was performed with a sieve of 150 μm to remove coarse particles, air classification was performed to remove fine particles, and low-magnetic components were further removed by magnetic separation to obtain porous magnetic core particles 1.

Step 7 (Filling Step)

A total of 100 parts of the porous magnetic core particles 1 was placed in a stirring vessel of a mixing stirrer (all-purpose stirrer NDMV type manufactured by Dalton Co., Ltd.), the temperature was maintained at 60° C., and 5 parts of a filling resin including 95% by mass of a methyl silicone oligomer and 5.0% by mass of γ-aminopropyltrimethoxysilane was added dropwise under normal pressure.

After completion of the dropwise addition, stirring was continued while adjusting the time, the temperature was raised to 70° C., and the particles of each porous magnetic core were filled with the resin composition.

The resin-filled magnetic core particles obtained after cooling were transferred to a mixer (drum mixer UD-AT type manufactured by Sugiyama Heavy Industries, Ltd.) having a spiral blade in a rotatable mixing container, and the temperature was raised, under stirring, to 140° C. at a temperature rise rate of 2° C./min under a nitrogen atmosphere. Then, heating and stirring were continued at 140° C. for 50 min.

After cooling to room temperature, the resin-filled and cured ferrite particles were taken out and nonmagnetic substances were removed using a magnetic separator. Furthermore, coarse particles were removed by a vibrating screen to obtain a magnetic carrier core 1 filled with a resin and having a D50 of 38 μm.

Production Example of Magnetic Carrier Core 2

A total of 4.0 parts of a silane coupling agent (3-(2-aminoethylamino)propyltrimethoxysilane) was added to 100.0 parts of magnetite powder having a number average particle diameter of 0.30 μm, and fine particles were treated by high speed mixing and stirring at a temperature of 100° C. or higher in a vessel.

| | |
|---|---|
| Phenol | 10 parts |
| Formaldehyde solution (formaldehyde 40%, methanol 10%, water 50%) | 6 parts |
| Treated magnetite | 84 parts |

The above materials, 5 parts of 28% ammonia water and 20 parts of water were placed in a flask, heated to and kept at 85° C. for 30 min while stirring and mixing, and a polymerization reaction was performed for 3 h to cure the generated phenol resin. The cured phenolic resin was thereafter cooled to 30° C., water was further added, the supernatant was removed, and the precipitate was washed with water and then air dried. Subsequently, the precipitate was dried at a temperature of 60° C. under reduced pressure (5 mmHg or less) to obtain a spherical magnetic carrier core 2 having a D50 of 35 in a state in which the magnetic bodies were dispersed.

Production Example of Magnetic Carrier 1

| | |
|---|---|
| Magnetic carrier core 1 | 100.0 parts |
| Resin A-1 (resin solid fraction) | 2.0 parts |

The coating resin of the abovementioned number of parts, with respect to 100 parts of the magnetic carrier core 1, was diluted with toluene so that the resin component was 5%, and a sufficiently stirred resin solution was prepared as a coating resin 1. Thereafter, the magnetic carrier core 1 was placed in a planetary motion mixer (NAUTA MIXER VN type manufactured by Hosokawa Micron Corporation) maintained at a temperature of 60° C., and the above resin solution was loaded. As a method of loading, half of the resin solution was loaded, and a solvent removal and coating operation was performed for 30 min. Then, another half of the resin solution was loaded, and the solvent removal and coating operation was performed for 40 min.

Thereafter, the magnetic carrier coated with the resin coating layer was transferred to a mixer (drum mixer UD-AT type manufactured by Sugiyama Heavy Industries, Ltd.) having spiral blades in a rotatable mixing container, and heat treated for 2 h at the temperature of 120° C. under nitrogen atmosphere while stirring by rotating at 10 rev/min. The resulting magnetic carrier was separated from low-magnetic-force products by magnetic separation, passed through a sieve with an opening of 150 μm, and then classified with an air classifier to obtain a magnetic carrier 1.

Magnetic carriers 2 to 14 were obtained in the same manner as in Production Example of Magnetic Carrier 1, except that the combination of the magnetic carrier core and the resin, and the type and amount added of the coating resin were changed as shown in Table 2.

TABLE 2

| | Magnetic carrier No. | Magnetic carrier core No. | Coating resin Resin No. | Coating resin Coated amount, parts by mass |
|---|---|---|---|---|
| Example 1 | 1 | 1 | A-1 | 2.0 |
| Example 2 | 2 | 1 | A-2 | 2.0 |
| Example 3 | 3 | 2 | A-3 | 1.8 |
| Example 4 | 4 | 2 | A-4 | 1.8 |
| Example 5 | 5 | 2 | A-5 | 1.8 |
| Example 6 | 6 | 1 | A-6 | 2.0 |
| Example 7 | 7 | 1 | A-7 | 2.0 |
| Example 8 | 8 | 1 | A-8 | 2.0 |
| Example 9 | 9 | 1 | A-9 | 2.0 |
| Example 10 | 10 | 1 | A-10 | 2.0 |
| Example 11 | 11 | 2 | A-11 | 1.8 |
| Example 12 | 12 | 2 | A-12 | 1.8 |
| Comparative Example 1 | 13 | 2 | A-13 | 1.8 |
| Comparative Example 2 | 14 | 2 | A-14 | 1.8 |

Production Example of Toner (Cyan Toner, Magenta Toner, and Yellow Toner)

Materials shown in Table 3 were thoroughly mixed with a Henschel mixer (FM-75J, manufactured by Nippon Coke Industry Co., Ltd.), and then kneaded with a twin-screw kneader (trade name: PCM-30, manufactured by Ikegai Iron and Steel Co., Ltd.) set to a temperature of 130° C. at a feed amount of 10 kg/h (kneaded product temperature at the time of discharge was 150° C.). The resulting kneaded product was cooled, coarsely pulverized with a hammer mill, and then finely pulverized with a mechanical pulverizer (trade name: T-250, manufactured by Turbo Kogyo Co., Ltd.) at a feed amount of 10 kg/h. The particles obtained had a weight average particle diameter of 4.3 μm.

The monomer composition of the polyester resin was as follows. (Composition: 40 parts of polyoxypropylene (2.2)-2,2-bis (4-hydroxyphenyl)propane, 10 parts of polyoxyethylene (2.2)-2,2-bis(4-hydroxyphenyl)propane, 40 parts of terephthalic acid, 2 parts of trimellitic anhydride, and 8 parts of fumaric acid)

The obtained particles were classified with a rotary classifier (trade name: TTSP 100, manufactured by Hosokawa Micron Corporation) to cut fine powder and coarse powder. Cyan toner particles, magenta toner particles and yellow toner particles were obtained which had a weight average particle diameter of 5.0 μm, a presence ratio of 18.8% by number of particles having a particle diameter of 3.0 μm or less, and a presence ratio of 0.3% by volume of particles having a particle diameter of 10.0 μm or more.

Furthermore, the following materials were introduced into a Henschel mixer (trade name: Model FM-75J, manufactured by Nippon Coke Industry Co., Ltd.), the peripheral speed of the rotating blades was set to 35.0 (m/s), and mixing was performed for 3 min to adhere silica particles, titanium oxide particles and strontium titanate particles to the surface of the cyan toner particles, magenta toner particles and yellow toner particles and obtain a cyan toner, a magenta toner, and a yellow toner.

| | |
|---|---|
| Toner particles of each color: | 100.0 parts |
| Silica particles: (silica particles prepared by the fumed method were surface-treated with 1.5% by mass of hexamethyldisilazane and then adjusted to a desired particle size distribution by classification) | 3.0 parts |
| Titanium oxide particles: (metatitanic acid having an anatase-type crystallinity surface-treated with an octylsilane compound) | 1.7 parts |
| Strontium titanate particles: (surface-treated with an octylsilane compound) | 0.5 parts |

The cyan toner, magenta toner, and yellow toner and the magnetic carriers 1 to 14 materials were used, and each composition was shaken with a shaker (YS-8D: manufactured by Yayoi Corporation) so that the toner concentration was 7% by mass to prepare 300 g of a two-component developer. The amplitude condition of the shaker was 200 rpm for 2 min.

Meanwhile, 90 parts of each of the cyan toner, magenta toner, and yellow toner were added to 10 parts of each of magnetic carriers 1 to 14 and mixed for 5 min with a V-type mixer in an environment of normal temperature and normal humidity 23° C./50% RH to obtain replenishing developers.

TABLE 3

| | Toner particle | | | Weight average particle diameter |
|---|---|---|---|---|
| | Binder resin (100 parts) | Colorant | Release agent | of toner (μm) |
| Cyan toner | Polyester resin: Tg 58° C., acid value 15 mg KOH/g, hydroxyl group value 15 mg KOH/g, molecular weight: Mn 3500, Mw 95,000 | C. I. Pigment Blue 15:3 (5.5 parts) | Normal paraffin wax, 5.0 parts, melting point: 90° C. | 5.0 |
| Magenta toner | | C. I. Pigment Red 122 (7.0 parts) | | 5.0 |
| Yellow toner | | C. I. Pigment Yellow 180 (7.0 parts) | | 5.0 |

Examples 1 to 12 and Comparative Examples 1 and 2

The following evaluation was performed using the two-component developers and the replenishment developers.

A modified color copying machine imagePRESS C850 by Canon Inc. was used as an image forming apparatus.

The two-component developer was placed in each color developing device, replenishing developer containers including the developer for each color replenishment were set, an image was formed, and various evaluations were conducted before and after a durability test.

As a durability test, a chart of FFH output with an image ratio of 5% was used under a printing environment of temperature 23° C./humidity 5 RH % (hereinafter "N/L"), and durability evaluation of 20000 prints was performed. Further, under the printing environment of temperature 30° C./humidity 80 RH % (hereinafter "H/H"), a chart of FFH output with an image ratio of 5% was similarly used and durability evaluation of 20000 prints was performed.

FFH, as referred to herein, is a value representing 256 gradations in hexadecimal, 00h being the first gradation (white area) of 256 gradations, and FFH being the 256-th gradation (solid part) of 256 gradations.

Conditions

Paper: laser beam printer paper CS-814 (81.4 g/m$^2$) (Canon Marketing Japan Co., Ltd.)

Image formation speed: A4 size, full color 85 prints/min

Development conditions: the modification was such that the development contrast could be adjusted to an arbitrary value, and the automatic correction by the main body could not be operated. The modification also made it possible to change the peak-to-peak voltage (Vpp) of the alternating electric field in increments of 0.1 kV from Vpp of 0.7 kV to 1.8 kV at a frequency of 2.0 kHz.

Each evaluation item is shown below.

(1) Transferability to Thick Paper

Immediately after conducting the 20000-print durability test with an FFH output chart with an image ratio of 5% in an N/L environment, evaluation of transferability of a black solid image obtained with three colors was performed with respect to an all-solid superimposed image of three colors of yellow, magenta and cyan on a 180 g/m$^2$ thick paper at the time of matching the transfer current demonstrating the best transfer efficiency. The evaluation criteria are as follows.

A: a uniform black solid image is printed.

B: when viewed under a strong light, a somewhat uneven and rough solid image can be confirmed.

C: somewhat uneven and rough solid image.

D: uneven and rough solid image.

(2) Voids when Used for a Long Time in H/H Environment

After conducting the 20000-print durability test with an FFH output chart with an image ratio of 5% in an H/H environment, the toner was allowed to stand for 1 day in the same environment. Thereafter, a chart on which 10 thin lines of 4 dots were drawn at intervals of 10 mm in the longitudinal direction was outputted on 180 g/m$^2$ thick paper, and 10 places were observed visually and with a loupe (×30) to evaluate voids. The evaluation criteria for the voids are as follows.

Evaluation Criteria

A: there are no voids.

B: one or two voids have occurred.

C: three or four voids have occurred.

D: five or more voids have occurred.

(3) Fogging After Long-Term use in H/H Environment

After conducting the 20000-print durability test with an FFH output chart with an image ratio of 5% in an H/H environment, the toner was allowed to stand for 3 days in the same environment. After that, an image (00h image) having a white background portion was outputted using three colors: yellow, magenta and cyan.

Image fogging was evaluated by calculating a fogging density (%) from the difference between the whiteness of the white background portion of the printout image and the whiteness of the recording material measured with "REFLECTMETER MODEL TC-6DS" (manufactured by Tokyo Denshoku Co., Ltd.). A green light filter was used for the evaluation.

A: less than 1.0%.
B: 1.0% or more and less than 1.5%.
C: 1.5% or more and less than 2.0%.
D: 2.0% or more.

(4) Overall Determination

The evaluation ranks in the evaluation items (1) to (3) were quantified, and the total value was determined according to the following criteria.

In the evaluation items, A=5, B=4, C=3, and D=2.

It was determined that the effects of the present invention were obtained when the total value of the overall determination was 10 or more.

The results are shown in Table 4.

TABLE 4

| | Transfer unevenness | | Voids | | Fogging | | |
|---|---|---|---|---|---|---|---|
| | Rank | Evaluation | Number of voids | Evaluation | Fogging density (%) | Evaluation | Overall evaluation |
| Example 1 | A | 5 | 0 | 5 | 0.5 | 5 | 15 |
| Example 2 | A | 5 | 0 | 5 | 0.6 | 5 | 15 |
| Example 3 | A | 5 | 0 | 5 | 0.6 | 5 | 15 |
| Example 4 | A | 5 | 0 | 5 | 0.7 | 5 | 15 |
| Example 5 | A | 5 | 1 | 4 | 0.7 | 5 | 14 |
| Example 6 | A | 5 | 1 | 4 | 0.8 | 5 | 14 |
| Example 7 | A | 5 | 0 | 5 | 1.1 | 4 | 14 |
| Example 8 | B | 4 | 1 | 4 | 0.9 | 5 | 13 |
| Example 9 | B | 4 | 0 | 5 | 1.2 | 4 | 13 |
| Example 10 | C | 3 | 2 | 4 | 1.3 | 4 | 11 |
| Example 11 | B | 4 | 2 | 4 | 1.5 | 3 | 11 |
| Example 12 | C | 3 | 2 | 4 | 1.4 | 4 | 11 |
| Comparative Example 1 | C | 3 | 3 | 3 | 1.8 | 3 | 9 |
| Comparative Example 2 | D | 2 | 5 | 2 | 1.4 | 4 | 8 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-185458, filed Sep. 28, 2018, which is hereby incorporated by reference herein in its entirety.

What is claimed is:

1. A magnetic carrier comprising a magnetic carrier core and a resin coating layer formed on the surface of the magnetic carrier core, wherein the resin coating layer includes a polymer having a structure represented by the following formula (1), and a content ratio of the structure represented by the formula (1) is from 5% by mass to 95% by mass based on a resin component of the resin coating layer,

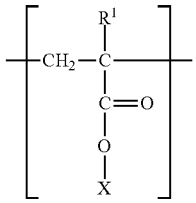

(1)

wherein, $R^1$ is H or $CH_3$, and X is a structure represented by the following formula (2):

$$—(C_mH_{2m})—R^2—(C_nH_{2n})—OH \quad (2)$$

wherein, $R^2$ is a hydrocarbon group being a cyclic structure having 4 to 8 carbon atoms, and m and n are integers of 0 to 4.

2. The magnetic carrier according to claim 1, wherein the polymer having a structure represented by the formula (1) further has a structure represented by the following formula (3):

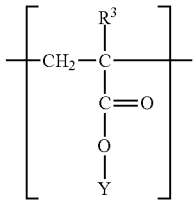

(3)

wherein, $R^3$ represents H or $CH_3$, and Y is H or a hydrocarbon group having 1 to 20 carbon atoms.

3. The magnetic carrier according to claim 1, wherein the polymer having a structure represented by the formula (1) further has a structure derived from styrene represented by the following formula (St).

(St)

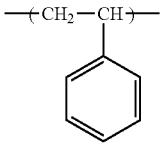

4. The magnetic carrier according to claim 1, wherein the polymer having a structure represented by the formula (1) further has a structure represented by the following formula (4):

(4)

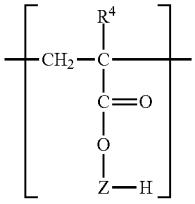

wherein, $R^4$ represents H or $CH_3$, and Z is a bivalent functional group having a polymer as a main chain, and the polymer is a polymer of at least one monomer selected from the group consisting of methyl acrylate, methyl methacrylate, ethyl acrylate, ethyl methacrylate, propyl acrylate, propyl methacrylate, butyl acrylate, butyl methacrylate, 2-ethylhexyl acrylate, 2-ethylhexyl methacrylate, styrene, and acrylonitrile.

5. The magnetic carrier according to claim 1, wherein the polymer having a structure represented by the formula (1) further has a structure derived from a (meth)acrylic acid ester monomer having a hydroxyl group and represented by the following formula (H):

(H)

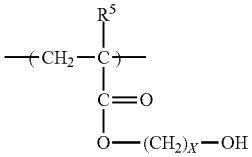

wherein, $R^5$ represents H or $CH_3$, and X represents an integer of 1 to 8.

6. An image forming method comprising:

a charging step of charging an electrostatic latent image bearing member;

an electrostatic latent image forming step of forming an electrostatic latent image on a surface of the electrostatic latent image bearing member;

a developing step of developing the electrostatic latent image by using a two-component developer to form a toner image;

a transfer step of transferring the toner image to a transfer material with or without an intermediate transfer member; and a fixing step of fixing the transferred toner image to the transfer material, wherein the two-component developer comprises a toner having a toner particle including a binder resin, and a magnetic carrier, wherein the magnetic carrier is the magnetic carrier according to claim 1.

7. A replenishing developer for use in an image forming method which comprises:

a charging step of charging an electrostatic latent image bearing member;

an electrostatic latent image forming step of forming an electrostatic latent image on a surface of the electrostatic latent image bearing member;

a developing step of developing the electrostatic latent image by using a two-component developer in a developing device to form a toner image;

a transfer step of transferring the toner image to a transfer material with or without an intermediate transfer member; and a fixing step of fixing the transferred toner image to the transfer material, and in which the replenishing developer is replenished to the developing device in accordance with a reduction in toner concentration in the two-component developer in the developing device, wherein the replenishing developer includes a magnetic carrier and a toner having a toner particle including a binder resin, the replenishing developer includes from 2 parts by mass to 50 parts by mass of the toner with respect to 1 part by mass of the magnetic carrier, and the magnetic carrier is the magnetic carrier according to claim 1.

8. An image forming method which comprises:

a charging step of charging an electrostatic latent image bearing member;

an electrostatic latent image forming step of forming an electrostatic latent image on a surface of the electrostatic latent image bearing member;

a developing step of developing the electrostatic latent image by using a two-component developer in a developing device to form a toner image;

a transfer step of transferring the toner image to a transfer material with or without an intermediate transfer member; and a fixing step of fixing the transferred toner image to the transfer material, and in which a replenishing developer is replenished to the developing device in accordance with a reduction in toner concentration in the two-component developer in the developing device, wherein the replenishing developer includes a magnetic carrier and a toner having a toner particle including a binder resin, the replenishing developer includes from 2 parts by mass to 50 parts by mass of the toner with respect to 1 part by mass of the magnetic carrier, and the magnetic carrier is the magnetic carrier according to claim 1.

9. A two-component developer comprising a toner having a toner particle including a binder resin, and a magnetic carrier, wherein the magnetic carrier comprises a magnetic carrier core and a resin coating layer formed on the surface of the magnetic carrier core, wherein the resin coating layer includes a polymer having a structure represented by the following formula (1), and a content ratio of the structure represented by the formula (1) is from 5% by mass to 95% by mass based on a resin component of the resin coating layer, (1)
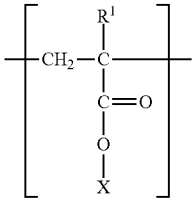
wherein, $R^1$ is H or $CH_3$, and X is a structure represented by the following formula (2):
$$—(C_mH_{2m})—R^2—(C_nH_{2n})—OH \quad (2)$$
wherein, $R^2$ is a hydrocarbon group being a cyclic structure having 4 to 8 carbon atoms, and m and n are integers of 0 to 4.
* * * * *